United States Patent [19]

Grant et al.

[11] Patent Number: 4,481,034

[45] **Date of Patent: * Nov. 6, 1984**

[54] PROCESS FOR PRODUCING HIGH HAFNIUM CARBIDE CONTAINING ALLOYS

[75] Inventors: Nicholas J. Grant, Winchester, Mass.; Ramon K. Robinson, Bellevue, Wash.

[73] Assignee: Massachusetts Institute of Technology, Cambridge, Mass.

[ * ] Notice: The portion of the term of this patent subsequent to Apr. 18, 1995 has been disclaimed.

[21] Appl. No.: 417,671

[22] Filed: Sep. 13, 1982

Related U.S. Application Data

[63] Continuation-in-part of Ser. No. 381,363, May 24, 1982, which is a continuation-in-part of Ser. No. 165,630, Jul. 3, 1980, abandoned, which is a continuation-in-part of Ser. No. 664,207, Mar. 3, 1976, abandoned, which is a continuation-in-part of Ser. No. 371,318, Jun. 18, 1973, abandoned.

[51] Int. Cl.[3] ..... C22C 19/08

[52] U.S. Cl. ..... 75/236; 75/246; 148/403

[58] Field of Search ..... 419/30, 33; 75/0.5 C, 75/236; 148/403

[56] References Cited

U.S. PATENT DOCUMENTS 3,598,567 8/1971 Grant ..... 75/243

4,084,964 4/1978 Grant et al. ..... 148/427

*Primary Examiner*—Benjamin R. Padgett

*Assistant Examiner*—Virginia Caress

*Attorney, Agent, or Firm*—Arthur A. Smith, Jr.; Anthony M. Lorusso

[57] ABSTRACT

Disclosed is a process for forming a new group of cobalt-based alloys containing 3–18% hafnium carbide (HfC), the HfC having a particle size finer than about three microns. The class of alloys exhibits excellent tensile strength characteristics at very low temperatures, exhibits very good time-temperature stability, and shows excellent oxidation characteristics even at temperatures above about 1000° C. In addition, the alloy is attractive for use in the wrought state because of its ductility and low-temperature toughness characteristics.

3 Claims, 18 Drawing Figures

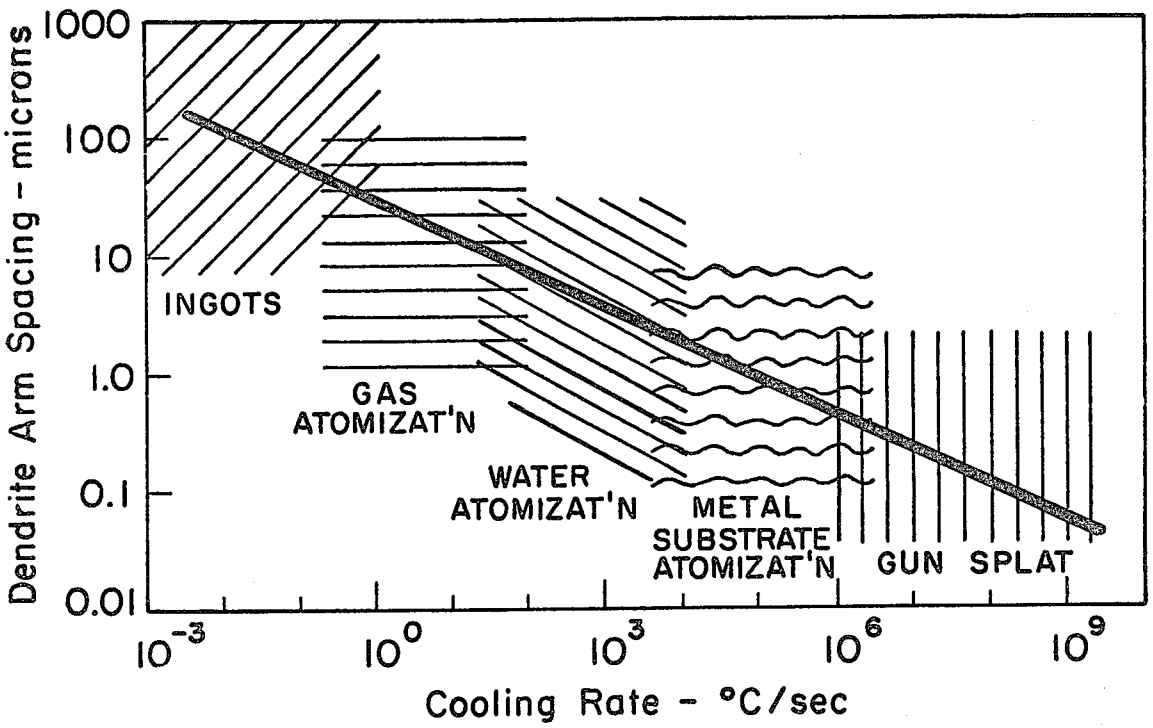
FIG. 1 Dendrite arm spacing as a function of cooling rate for aluminum and aluminum alloys.

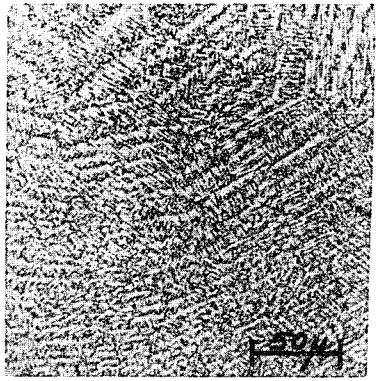
FIG. 2c
FIG. 2b
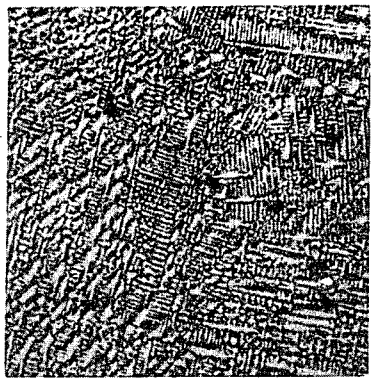
FIG. 2a

FIG. 3a
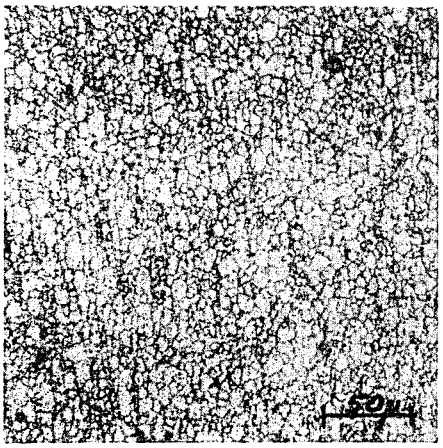
FIG. 3b
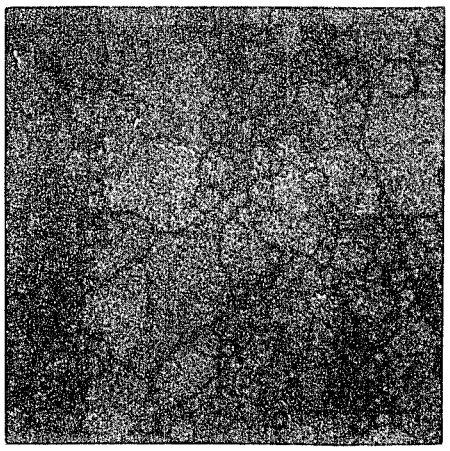
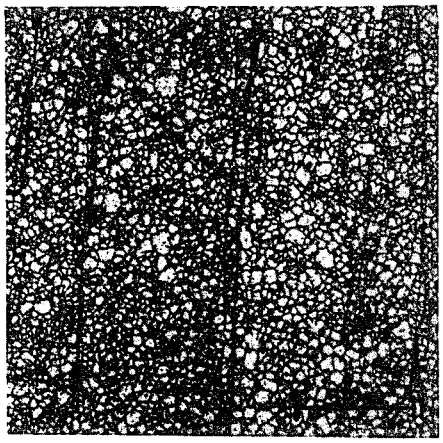
FIG. 3c
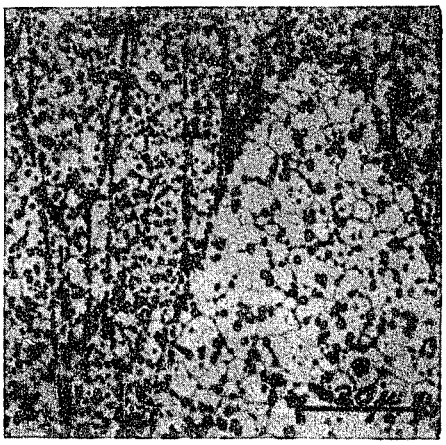
FIG. 3d

FIG. 4a
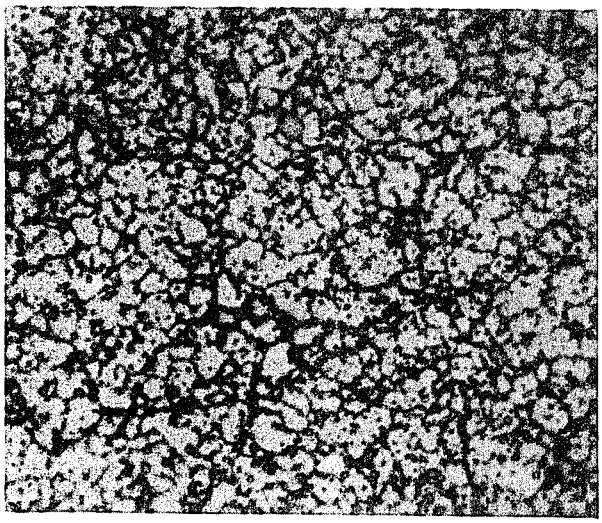
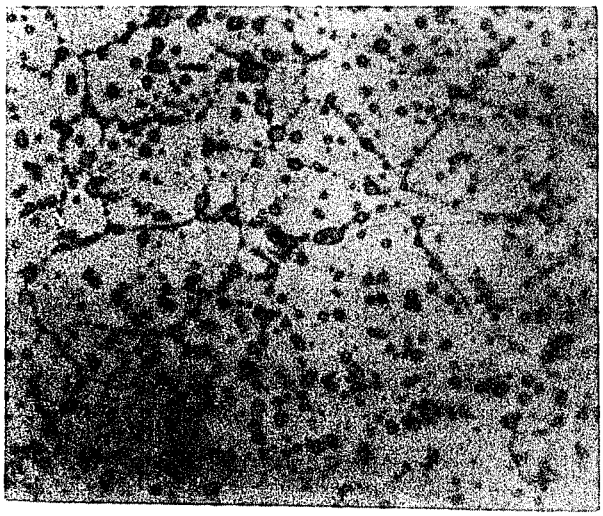
FIG. 4b

EFFECT OF TMT ON 1800°F (982°C) STRESS RUPTURE PROPERTIES OF COBALT-3 ATOM % HFC (CH6-H1-HE).

EFFECT OF TMT ON 1500°F (815°C) STRESS RUPTURE PROPERTIES OF COBALT-3 ATOM % HFC.

EFFECT OF TMT ON 1200°F (649°C) STRESS RUPTURE PROPERTIES OF P/M COBALT-1 AND 3 ATOM % HfC.

EFFECT OF TMT ON 1800°F (982°C) STRESS RUPTURE PROPERTIES OF P/M MAR-M-509.

EFFECT OF ANNEALING TREATMENT ON 1800°F (982°C) STRESS RUPTURE PROPERTIES OF P/M MAR-M-509.

PROCESS FOR PRODUCING HIGH HAFNIUM CARBIDE CONTAINING ALLOYS

The Government has rights in this invention pursuant to Contract Number DAHC15-70-C-0283 awarded by the U.S. Army.

REFERENCE TO RELATED APPLICATIONS

This application is a continuation-in-part of U.S. application Ser. No. 381,363, filed May 24, 1982, which is a continuation-in-part of U.S. application Ser. No. 165,630, filed July 3, 1980, now abandoned, which is a continuation-in-part of U.S. application Ser. No. 664,207, filed Mar. 3, 1976, now abandoned, which is a continuation-in-part of U.S. application Ser. No. 371,318, filed June 18, 1973, now abandoned, all entitled "Process for Producing High HfC-Containing Alloys", the disclosures of which are incorporated herein by reference.

BACKGROUND OF THE INVENTION

A major goal of current research in alloy development is the formulation of alloys exhibiting excellent strength properties, oxidation resistance, and good ductility over a wide range of temperatures; in particular at temperatures exceeding 1000° C. Preferably, these alloys should be easy to fabricate and relatively inexpensive. To achieve these ends, superalloys based on either nickel or cobalt have been studied and developed over many years; however, in some present applications such as dynamic parts for gas turbine jet engines, the currently utilized nickelbase superalloys, age hardened by a $Ni_3(Al,Ti)$ dispersion in the alloy, have reached their maximum effectiveness. An attractive alternative to the nickel superalloys are cobalt or cobalt-nickel based alloys containing carbides of Groups IV and V metals dispersed therein, particularly carbides of hafnium and zirconium.

Since it is known that the formation of small amounts of hafnium carbide in cobalt alloys improves high temperature properties, a method has been sought whereby the small amount of hafnium carbide in the alloy could be increased to a relatively large amount. Prior to the present invention, the addition of large amounts of hafnium (about 3%) has yielded alloys with large amounts of coarse carbides, coring and micro and macrosegregation of the hafnium carbide. These current hafnium containing alloys have large secondary dendrite arm spacings (on the order of 50 to 1000 microns) and are brittle, non-workable hot or cold, and inferior to the current nickel superalloys.

A further description of the background of the invention may be found in the doctoral thesis of inventor Robinson, entitled "Development of P/M Cobalt-Base Alloys Using Rapidly Quenched, Pre-Alloyed Powders", which is incorporated herein by reference. A copy of the thesis was filed with U.S. application Ser. No. 371,318 and a separate copy was deposited in the M.I.T. library system on or about Sept. 11, 1973. The work forming the basis of this thesis was conducted under the supervision of inventor Grant.

A number of different quenching techniques have been utilized in the formation of the superalloy powders and particulates. Quench rates for conventional ingot or precision casting processes are in the order of $10^{-2}$° to $10^{-1}$°C./second, whereas rates from $10^{2}$° to $10^{5}$° C. per second are reported for some atomizing and splat quenching processes. Common powder formation processes employ water, air, steam, and inert and soluble gases for disintegrating the molten metal into fine droplets to promote rapid quenching. Splat quenching (rapid solidification against a metallic substrate) can also be used. Generally, these processes involve bringing the molten mass to the liquid state and then disintegrating the melt into droplets or particulates to promote rapid solidification. The powders or particulates formed by these processes are then consolidated to full density (by hot isostatic pressing or hot extrusion, for example). The resultant wrought alloys show excellent properties and commercial potential.

SUMMARY OF THE INVENTION

The present invention comprises an improvement in superalloy formation wherein the superalloy formed exhibits excellent strength, ductility, and oxidation resistance even at temperatures greater than 1000° C. In particular, the present invention comprises a process for producing a substantially uniform dispersion of extremely fine hafnium carbide particles in a cobalt-based alloy product.

It is known scientifically and in the metallurgical art that hafnium carbide is the most stable metal carbide. the disclosed invention utilizes extremely rapid quenching to guarantee the formation of hafnium carbide and prevent or inhibit the formation of other, less desirable carbides such as chromium carbide. Starting with ingredients to produce a composition containing 10–30% chromium (all percentages are by weight), up to 20% nickel, 4–12% tungsten and/or molybdenum, 3–18% hafnium, and sufficient carbon to combine with substantially all of the hafnium to form hafnium carbide (the balance being the cobalt matrix), one prepares a master alloy. The master alloy is then remelted and held in the molten state for sufficient time to achieve homogeneity. The melt is then rapidly cooled (as atomized powders or splat quenched particulates) at rates of $10^{2}$° to $10^{9}$° C./second to form preferentially hafnium carbide in a highly refined, fine grained cobalt-based matrix. The resulting cobalt-based alloy contains a uniform dispersion of fine and stable HfC in an austentic matrix containing about 10 to 30% chromium, up to 20% nickel, and 4 to 12% tungsten and/or molybdenum as well as 2 to 24% by volume of hafnium carbide within this tough oxidation-resistant matrix. The hafnium carbide particle size is less than 3 microns and essentially all the hafnium and carbon in the alloy is in the form of hafnium carbide.

In one aspect of the invention, the quench rate is between $10^{2}$° to $10^{5}$° C./second and the secondary dendrite arm spacing is 10 microns or finer. The necessary rapid cooling can be effected by atomization of the liquid melt into fine droplets which are rapidly solidified in the atomizing fluid or quenched against a metal substrate such as copper or molybdenum rolls. Various gases which may be used to atomize the liquid melt into fine droplets so as to promote rapid solidification include the inert gases, steam or water, and nitrogen. Up to 40% of the cobalt in the melt can be replaced by nickel or a nickel/iron mixture.

In another aspect of the invention, the quenching rate is in the order rate of $10^{5}$° to $10^{9}$° C./second which yields a secondary dendrite arm spacing on the order of 0.1 microns. In still another aspect of the invention, agglomeration of the hafnium carbide into clusters is minimized by careful prior temperature exposure of the rapidly solidified particulates. The prior temperature control nucleates any hafnium and carbon still in supersaturated solutions thereby forming fine HfC particles.

Accordingly, an object of the invention is to provide a class of cobalt-based alloys which have high strength, high ductility, and excellent oxidation and corrosion resistance, are readily fabricated, are relatively inexpensive, and will maintain their ductility, toughness, strength and stability at temperatures in excess of 1000° C. Another object is to provide a powder or particulate metallurgy (P/M) process for making cobalt-based alloys. Still another object of the invention is to make a cobalt-based alloy containing substantial amounts of hafnium carbide without significant amounts of other carbides being present.

These and other objects of the invention will be apparent from the detailed description of the preferred embodiment and the drawing.

BRIEF DESCRIPTION OF THE DRAWING

The invention is hereinafter discussed with reference to the accompanying drawing in which:

FIG. 1 is a graph showing dendrite arm spacing as a function of cooling rate for aluminium and aluminium alloys;

FIGS. 2(*a*), 2(*b*) and 2(*c*) are reproductions of photomicrographs (×300) showing dendritic structures of atomized powders formed respectively of steam atomized alloy Co-1 HfC, 3 mm diameter; rotating electrode atomized alloy CO-2 HfC, 0.4 mm diameter; and vacuum atomized CO-3 HfC, 0.3 mm diameter;

FIGS. 3(*a*), 3(*b*), 3(c) and 3(*d*) are reproductions of photomicrographs showing microstructures of Co-HfC alloys of the present invention formed by hot isostatic pressing (HIP) and extrusion of powders containing, respectively, 1 atom % HfC (×300), 1 atom % HfC after re-HIP, darkfield (×200), 2 atom % HfC (×400) and 3 atom % HfC (×1000);

FIGS. 4(*a*) and 4(*b*) are reproductions of photomicrographs (×1500) showing HIP and extruded powders of Co-HfC powders made using the present process, having 3 atom % HfC and showing the worked powders respectively in the as-extruded condition and after a one-hour anneal of 2440° F. (1340° C.);

DETAILED DESCRIPTION OF PREFERRED EMBODIMENT

Figure 5:
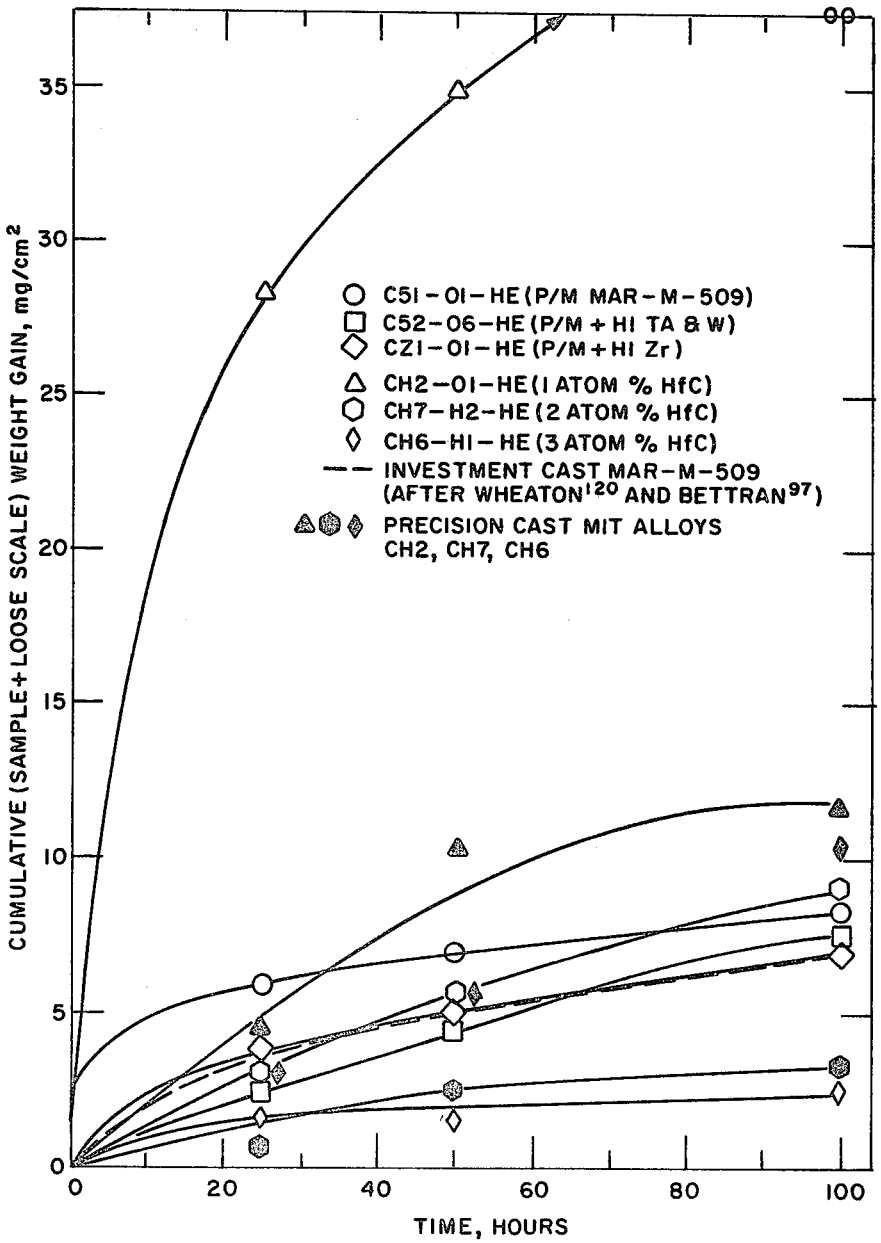
FIG. 5 is a graph of pseudo-dynamic oxidation characteristic of a group of powder metallurgy (P/M) and cast cobalt-based alloys in still air at 2000° F. (1093° C.).

The present invention discloses a process whereby a cobalt-based superalloy having excellent oxidation resistance, ductility, and strength over a wide variety of temperatures is fabricated. In brief, the process comprises making a melt of a cobalt-based alloy which includes a large quantity of hafnium and sufficient carbon to form hafnium carbide, holding the melt at a temperature for a period long enough to allow homogeneity to occur, rapidly solidifying the melt to form preferentially hafnium carbide, and then consolidating the alloy. The rapid quenching inhibits the production of carbides other than hafnium carbide thereby yielding better properties in the alloy, and endowing the alloy with stable performance at very high temperatures.

The disclosed process yields a uniform dispersion of an extremely fine and stable carbide phase in a cobalt-based alloy. The alloy is made from a melt containing 10 to 30% by weight chromium, 4 to 12% tungsten and/or molybdenum, 3 to 18% hafnium, carbon balanced to assure formation of hafnium carbide to the exclusion of other carbides, and the remainder cobalt. Up to 40% of the cobalt may be substituted for by nickel or a nickel-iron mixture. The alloy is melted and held at a high temperature for sufficient time for homogeneity of the melt to occur. In a preferred embodiment, the melt is held at 1650° C. for approximately 10 to 30 minutes, depending on melt size. The melt is then rapidly solidified at a rate of $10^{2}$° to $10^{9}$° C./second. Various methods may be used to achieve this high quenching rate. In one embodiment, the alloy may be splat quenched against copper or molybdenum rolls. The use of molybdenum rolls yields a quenching rate of approximately $10^{6}$° C./second. The splat quenching may be carried out by the twin roller method or the melt spinning method. In another embodiment, powder or particulate metallurgical processes (P/M) may be used to achieve the rapid cooling, for example by ultrasonic gas atomization. In a P/M process, water, steam, inert gases (e.g., argon, helium, etc.), nitrogen, or soluble gases are utilized for disintegrating the liquid metal into droplets; however, inert gases are preferred. The droplets are rapidly cooled to form a powder or particulate which is particularly useful for production of wrought products.

FIG. 1 illustrates the relationship between the secondary dendrite arm spacing and cooling rate. Since the cooling rate in the process is at least $10^{2}$° C./second, the secondary dendrite arm spacing is less than 10 microns which, by preferred hot working methods, leads to grain sizes finer than about 20 microns. As the cooling rates are increased, such as by splat cooling the alloy against molybdenum rolls, the secondary dendrite arm spacing decreases, yielding a corresponding smaller grain size in the wrought product. Examples of typical dendrite arm spacings in atomized alloys are shown in FIG. 2. The resulting alloy has dispersed therein fine precipitates of hafnium carbide in an austenitic cobalt-based matrix (FIG. 3). The carbon in the alloy is balanced stoichiometrically to produce hafnium carbide in the alloy to the exclusion of other less desirable carbides. In addition to the previously mentioned constituents, the alloy may include one or more of the group consisting of titanium, tantalum, columbium and zirconium, but hafnium is the preferred carbide former. Also, small amounts of boron and/or silicon may be included to assist in atomization in the powder process. The resultant Co-based HfC powder contains hafnium carbide having a particle size finer than about 3 microns uniformly dispersed therein in amounts by volume in the range of 2% to 24%. While some alloys may contain small amounts of chromium carbide or other refractory carbides in quantities less than 20% volume of the hafnium carbide, by careful balancing of hafnium and carbon it is possible to eliminate the other carbides including the chromium carbide.

Example 1 below describes the preparation of a single alloy using the present teaching; Example 2 is more general and the process outlined includes the process of Example 1; and Example 3 is a special aspect of the more general process of Example 2.

EXAMPLE 1

To illustrate the concepts described herein, one of the powder metallurgy Co-HfC alloys in said thesis is now described: a Co-based, Cr-20, Ni-20, 9Hf, 5Mo, 0.6 C alloy was melted, hydrogen-vacuum atomized (FIG. 2A), consolidated by hot isostatic pressing (HIP), hot extruded and evaluated. A stable, fine and uniform dispersion of HfC (nominally 3 atom percent) stabilized the fine, equiaxed, as-extruded grain structure (FIG. 4*a*) for short term exposures at temperatures in excess of 2400° F. (1316° C.) as illustrated in FIG. 4*b* (regular Co-based alloys are in fact molten (in part) at 2350° F. and higher). Stored energy due to thermo-mechanical working (TMT) of the as-extruded rod (cold work plus intermediate anneals) was largely retained for up to 4 hours exposure at 2300° F. (1260° C.) as indicated by tensile property data in Table 1 below, and largely maintained the excellent as processed properties:

TABLE 1

| ALLOY | YS (0.2%) ksi | UTS ksi | ELONG % | R.A. % |
|---|---|---|---|---|
| as HIP & extruded | 132 | 187 | 4 | 4 |
| 30% reduction in area, with intermediate anneals | 200 | 250 | 13 | 14 |
| 30% reduction in area, with intermediate anneals + 4 hours @ 2300° F. | 174 | 235 | 13 | 14 |

Figure 6:
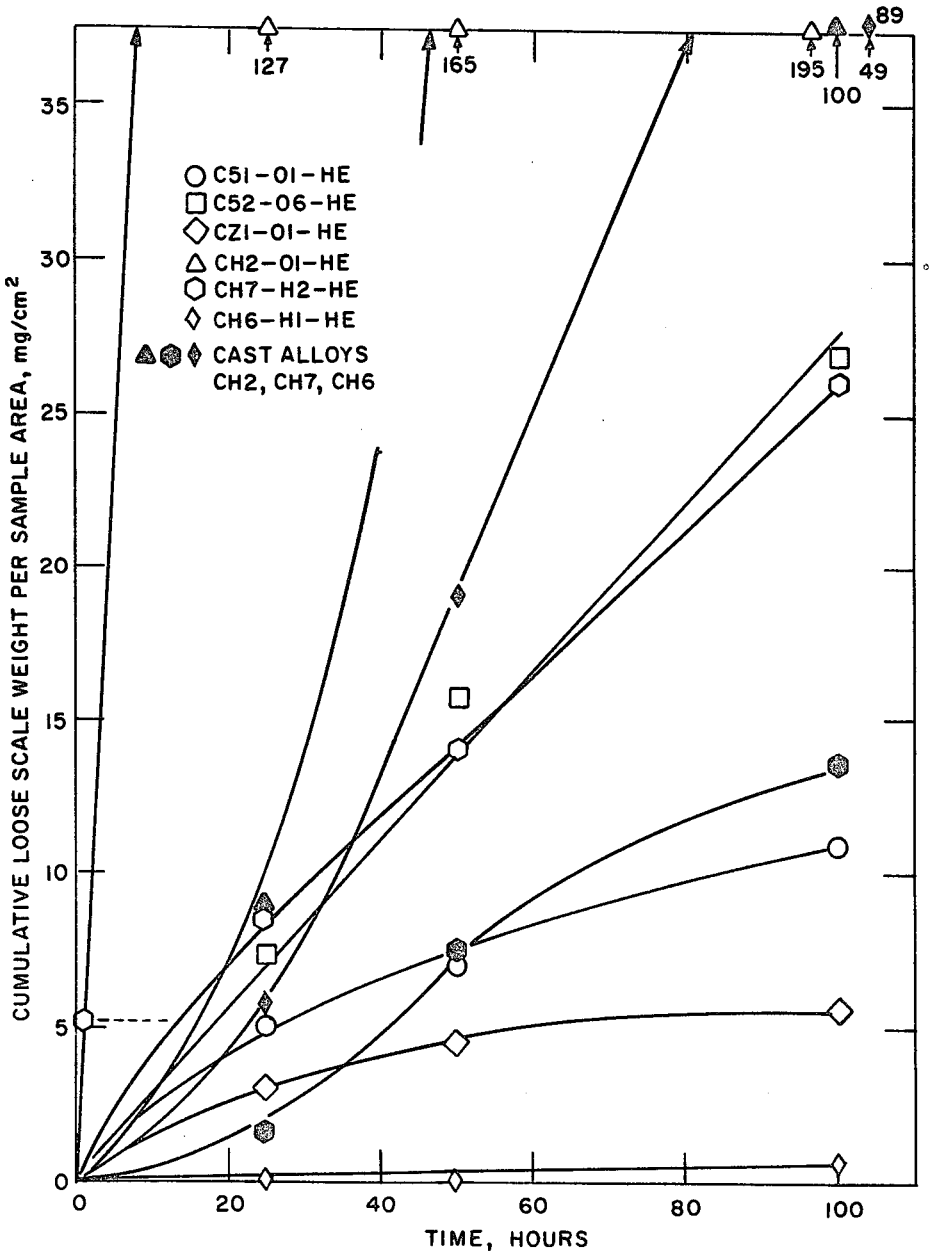
FIG. 6 is a graph of scaling characteristics of most of the alloys represented in FIG. 5, in still air at 2000° F. (1093° C.)
Figure 7:
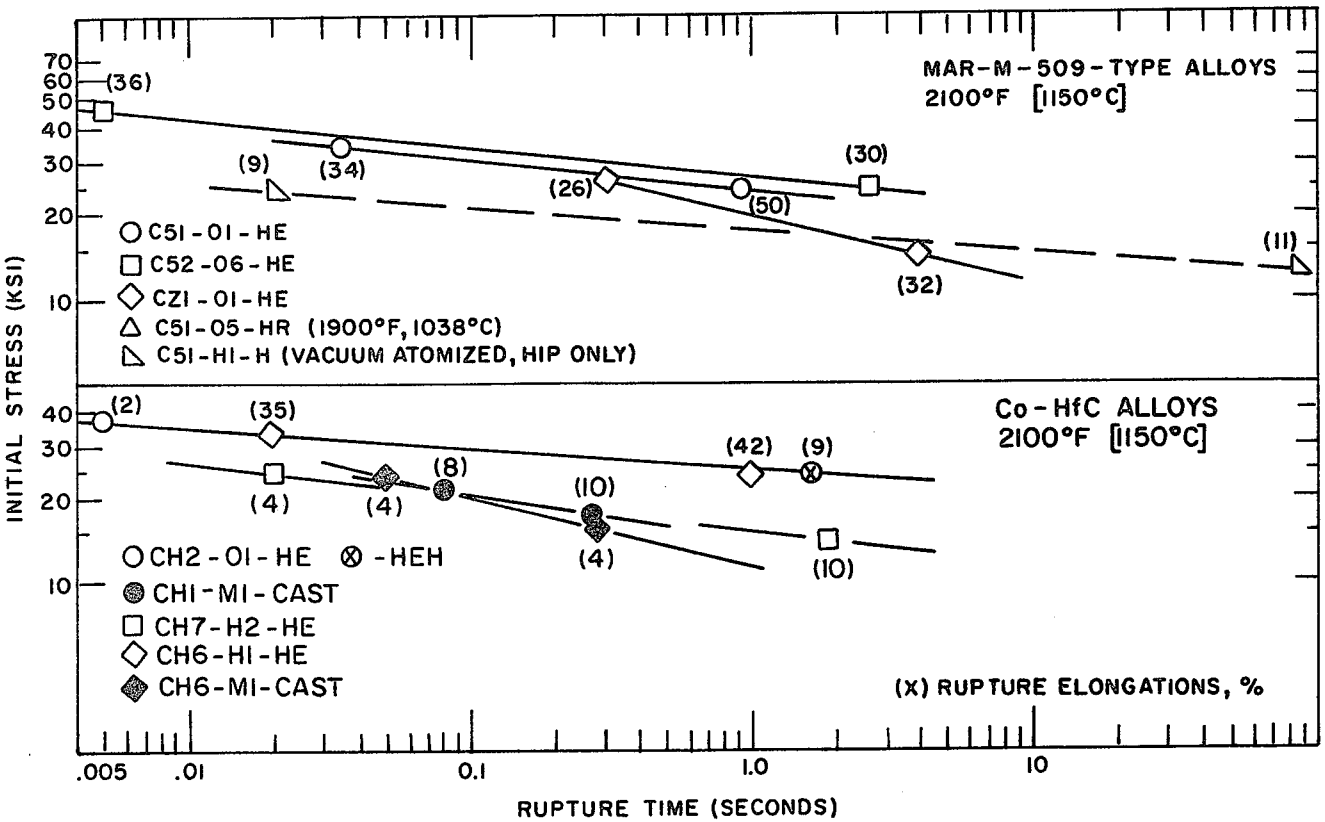
FIG. 7 is a graphic representation of high strain rate, stress-rupture data for most of the alloys represented in FIGS. 5 and 6 plus some others.
Figure 8:
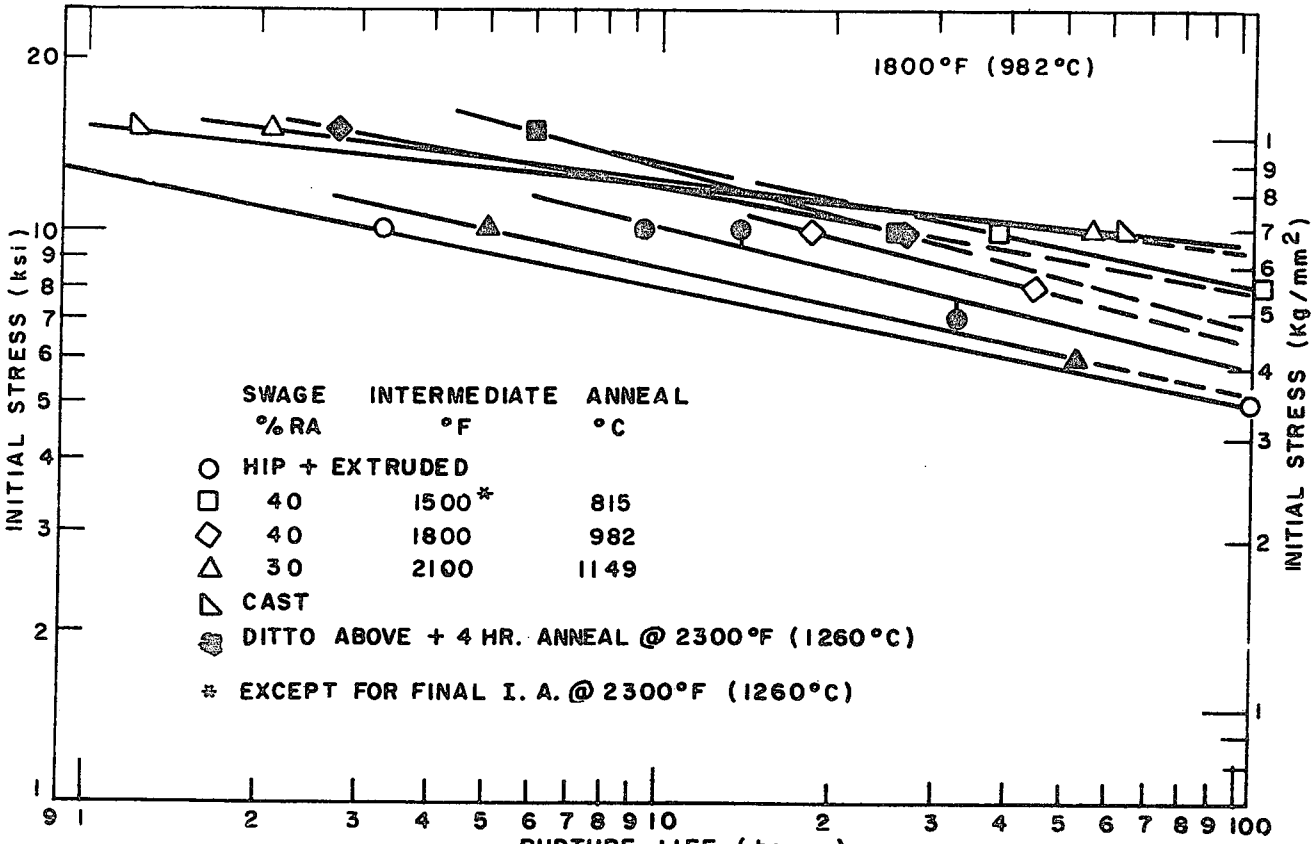
FIG. 8 is a graph of initial stress vs. rupture life for an alloy designated CH6-H1-HE, as hereinafter defined, that was made employing the present concepts and subjected to thermomechanical working.

Thermo-mechanical working was found to be effective to increase the room temperature ultimate tensile strength and yield strength from 187 and 132 ksi to 250 and 200 ksi, respectively. Such working almost doubled the stress rupture strength for 100 hour life at 1800° F. from 5 to 9.3 ksi; ductilities of this alloy are comparable to typical P/M alloys, exceeding the ductilities of precision-cast cobalt alloys by factors of 2–20. Oxidation resistance in static air at 2000° F. (1093° C.) is comparable to or exceeds that of the best commercially available cobalt-based superalloys (see FIGS. 6 and 7). Grain structure, even after swage-anneal treatments, was found to be very stable to annealing treatment up to 100 hours at 2300° F.

EXAMPLE 2

Cobalt-based hafnium-carbon alloys, with varying amounts of nickel, chromium and molybdenum in solution were dispersion hardened with up to 12 weight % HfC, using a rapid quenching powder metallurgy approach. Alloys containing the desired amounts of Hf+C and solid solution additives were obtained initially in vacuum-melted ingot form using conventional ingot technology, or alloying additives were put into the melt prior to atomization, or combinations of each method were employed. Stoichiometric, substoichiometric, and super-stoichiometric additions of carbon were made so as to be able to form exactly the compound HfC, HfC with excess Hf, and HfC with excess carbon contents, respectively. When Hf was added to the melt just prior to atomization, it was stirred into the melt after all other alloying additions had been made. After stirring in the Hf addition, the melt was held at about 2800° F. (1535° C.) for about one-half hour prior to atomizing. Using this method, complete homogenization of the melt was effected without undue oxidation-reaction of the hafnium with its environment, e.g., atmosphere and/or crucible. The molten alloys were atomized using steam, rotating electrode, and hydrogen-vacuum techniques to form rapidly quenched alloy particles having average sizes of 2,000, 350, and 200 microns (micrometers), respectively. The only powder requiring subsequent cleaning was the steam atomized powder which was subjected to repeated cycles of one hour each in hot aqueous, near alkaline potassium permanganate, followed by tumbling in inhibited HCl (hydrochloric acid) repeated up to 4–10 cycles.

After atomization (and cleaning for steam atomized powder), the powders were loaded into mild steel cans which were subsequently sealed except for a vacuum outgassing tube through which the loaded can was evacuated while heating to about 700° F. (371° C.), at which temperature the evacuation tube was crimped and welded shut. The evacuated and sealed cans were then cooled and placed in a hot isostatic pressing (HIP) autoclave which was subsequently pressurized from 15,000 to 30,000 psi for 1–2 hours at temperatures from 2000° F.(1093° C.) to 2325° F. (1274° C.) using argon gas as the pressurizing fluid.

After hot isostatic pressing or otherwise consolidating the powders into a fully dense form, the now consolidated powders were either further worked using hot or warm rolling or hot extrusion methods, or the consolidated powders were tested and evaluated in the hot isostatically pressed condition. The majority of the alloys were both HIP and extruded; therefore, operating parameters for both of these operations were found and are given in the thesis. Standard extrusion methods were employed with extrusion pre-heat temperatures ranging from 2000° F. (1093° C.) to 2050° F. (1121° C.) and extrusion ratios (area) varying from 11:1 to 22:1.

Consolidated alloys were examined in detail using various mechanical, chemical, physical and metallographic techniques. The testing procedures employed are known to workers in this art and, further, are discussed in great detail in the Robinson thesis. It should be noted that the discussion is applicable regardless whether the consolidated particulate metallurgy product was hot isostatically pressed only, or whether it was subsequently hot or warm worked by extrusion and/or rolling methods.

In addition to examining the produced properties of these alloys, additional metallurgical treatments were conducted to enhance the strength, structure, and stability of the alloys. High temperature solutionizing, aging, grain coarsening and oxidation treatments were studied. All treatments at temperatures up to and including 2000° F. (1093° C.) were conductd in a static air atmosphere furnace. For temperatures exceeding 2000° F. (1093° C.), test specimens and samples were either vacuum sealed in Vycor or quartz tubing, or they were packed in alumina boats which were subsequently placed in ceramic tubes continuously purged with flowing argon gas. Specimens used for the oxidation studies were placed in loosely-fitting, high purity alumina tubes to collect any loose scale. In all cases thermocouples were placed in the immediate vicinity of the specimens. All cooling was air cooling unless water quenching is otherwise specified.

Thermomechanical treatments were conducted using standard swage-anneal techniques. All HIP plus hot extruded P/M alloys were given swage-anneal treatments consisting of cold swaging up to a total of 40% reduction in area (RA) with intermediate anneals after about every 10% RA for one hour at single, selected temperatures of 1500° F. (816° C.), 1800° F. (982° C.), 2100° F. (1149° C.), and 2300° F. (1260° C.), for selected alloys. The majority of the cold swaging was done at M.I.T. on a Fen 3F swager. The mild steel cladding was removed from the extruded rods by dissolving in a 1:1 nitric acid solution prior to swaging.

EXAMPLE 3

Example 3 differs from Example 2 in four major respects: (1) a commercially available cobalt-based casting alloy was selected for the starting composition (MAR-M-509); (2) only steam and hydrogen-vacuum atomization techniques were employed; (3) tantalum, zirconium and chromium carbides were precipitated during atomization and subsequent high temperature treatments; this is in contrast to the predominantly single precipitate, HfC, found in Example 2; and (4) the Example 3 alloys responded to high temperature grain coarsening and solutionizing/aging treatments, whereas the stability of the Example 2 alloys was such that little or no high temperature structural instabilities were noted right up to the incipient melting points of the alloys.

The results of room temperature tensile tests for alloys of Example 2 and Example 3 are shown in Tables 2 and 3, respectively; some further strength properties are shown in FIGS. 8–10 and FIGS. 11–12, respectively, and further test results are given in the thesis.

TABLE 2

ROOM TEMPERATURE TENSILE PROPERTIES OF Co-HfC P/M AND CAST ALLOYS

| ALLOY | YS (0.2%) ksi | UTS ksi | Elong. % | R.A. % |
|---|---|---|---|---|
| Co-1 atom % HfC | | | | |
| CH1-M1-cast* | 60 | 82 | 12 | — |
| CH2-01-He-(HIP + Extr) | 98 | 142 | 4 | 6 |
| HEHS30N18A6 | 132 | 160 | 5.2 | 7.8 |
| HEHS40N21A6 | 168 | 186 | 11 | 12 |
| Co-2 atom % HfC | | | | |
| CH7-M1-cast* | 80 | 101 | 1.2 | 1 |
| CH8-C1-HIP only | 117 | 117 | <1 | <1 |
| CH7-H2-HE(HIP + Extr) | 105 | 154 | 7 | 5 |
| CH7-H2-HE S30N15A6 | 139 | 183 | 22 | 19 |
| CH7-H2-HE S30N18A6 | 169 | 204 | 5 | 6 |
| Co-3 atom % HfC | | | | |
| CH6-M1-cast* | 60 | 77 | 1.5 | 1 |
| CH4-M1-CR(5:1 RA @ 2100)A6 | 148 | 170 | 12 | 8 |
| CH6-M1-HE(HIP + Extr) | 132 | 187 | 4 | 4 |
| T23(4)A6 | 136 | 188 | 26 | 23 |
| S20N15A6 | 203 | 250 | 9 | 10 |
| S30N15A10 | 255 | 255 | <1 | <1 |
| S30N15A6 | 200 | 250 | 13 | 14 |
| S30N15T23(4)A6 | 174 | 235 | 13 | 14 |
| S20N18A6 | 151 | 201 | 26 | 24 |
| H6-H1-HES30N18A10 | 279 | 299 | 1 | 1 |
| S40N18A6 | 134 | 190 | 25 | 16 |
| S20N21 | 210 | 222 | 7.2 | 12 |

TABLE 2-continued

ROOM TEMPERATURE TENSILE PROPERTIES OF Co-HfC P/M AND CAST ALLOYS

| ALLOY | YS (0.2%) ksi | UTS ksi | Elong. % | R.A. % |
|---|---|---|---|---|
| S30N21T23(4)A6 | 126 | 181 | 26 | 19 |

Except for final I.A. @ 210° F.

*In all cases, note the very low strength values and the extremely poor ductility values for the cast version of the alloys which underwent slow cooling. The cast versions had coarse carbide phases and a mixture of carbides instead of HfC alone.

TABLE 3

ROOM TEMPERATURE TENSILE PROPERTIES OF MAR-M-509-TYPE P/M ALLOYS

| ALLOY HIP + EXTRUDED ALLOYS | YS (0.2%) ksi | UTS ksi | Elong % | R.A. % |
|---|---|---|---|---|
| MAR-M-509 P/M Alloy | | | | |
| C51-01-HE | 135 | 190 | 11 | 8 |
| C51-01-HE | 123 | 195 | 17 | 14 |
| T23(4)no age | 96 | 166 | 24 | 21 |
| S20N15A6 | 169 | 202 | 13 | 18 |
| S40N15*A6 | 166 | 198 | 13 | 15 |
| S30N18A6 | 164 | 200 | 14 | 12 |
| Hi W, Cr, and C Modification | | | | |
| C52-06-HE | 138 | 182 | 3 | 2 |
| T23(4)A6 | 130 | 174 | 15 | 12 |
| S30N21A6 | 166 | 198 | 12 | 14 |
| Hi Zr Modification | | | | |
| CZ1-01-HE | 129 | 188 | 6 | 7 |
| S22N15*A6 | 158 | 190 | 7.4 | 2 |
| S22N25*T23(4)A6 | 117 | 161 | 11 | 10 |
| HIP'ed MAR-M-509 P/M Alloys | | | | |
| C51 034-H2000(2) | 98 | 119 | 0.7 | <1 |
| C51 H1-H2235(2) | 122 | 161 | 6 | 6 |
| HIP'ed + Hot Rolled MAR-M-509 P/M Alloys | | | | |
| Longitudinal direction | 150 | 188 | 2 | 2 |
| C51-05-HR' (2:1 RA @ 1800) | 239 | 251 | <2 | <1 |
| HR' R 2:1 RA @ 1400) | 305 | 307 | <1 | <1 |

*except for final I.A. @ 2100° F. (1149° C.).

In the tables and in some of the figures certain shorthand terms are used to designate alloys made and tested. A listing of the characteristics of the terms used in the present specification follows. The terms employed have three groupings. Thus, for example, in the designation CH1-M1-cast, the first group, CH1, relates to: a standard master alloy, 1 atom % of HfC; the second group, M1, relates to: M.I.T., heat No. 1; and the third group, cast or C1, relates to a cast product. The further designations for the first group are now given: C5X=MAR-M-509-type alloy; C51=standard casting alloy chemistry; C52=Hi W, Cr, and C modified chemistry; CZX=M.I.T.'s cobalt-HfC alloy, in each case starting with the master alloy; CH1—standard master alloy chemistry, 1 atom % HfC; CH2=0.84% silicon and 0.04% boron added; CH3=0.05% boron plus Hf and C added to yield 3 atoms % HfC; CH4=Hf and C added to yield 3 atom % HfC; CH5=1% silicon, 0.05% boron, Hf and C added to yield 3 atom % HfC; CH6=Cr, Ni, C and Hf added to yield master alloy nominals except with 3 atom % HfC, CH7=Cr, Ni, C and Hf added to yield nominals except 3 atom % C and 2 atom % Hf. The second group specified the sources of the alloy which were Alleghany Ludlum, Chemstrand Homogeneous Metals, M.I.T. and I.M.T. The third group specified processing: A=age; A6=age 1600°-1650° F. for 20 hours; A21(4)=age 2100° F. for four hours; (Ageing times are always 20 hours unless specified otherwise in brackets); C=cast; E=extrude; H=HIP; M="melt dip" sample casting taken just prior to atomization; N=intermediate anneals after approximately each 10% RA; N18=intermediate anneal at 1800° F. (982° C.) for one hour; R=rolled (hot generally); R17=rolled at 1800° F. (982° C.); S40=swage to a total 40% reduction in area; T=heat treatment, e.g., solutionizing, grain coarsening, etc., for one hour unless otherwise specified; T20(4)=heat at 2000° F. (1093° C.) for four hours. Fractional 100° F. (56° C.) increments are written out in full.

Figure 9:
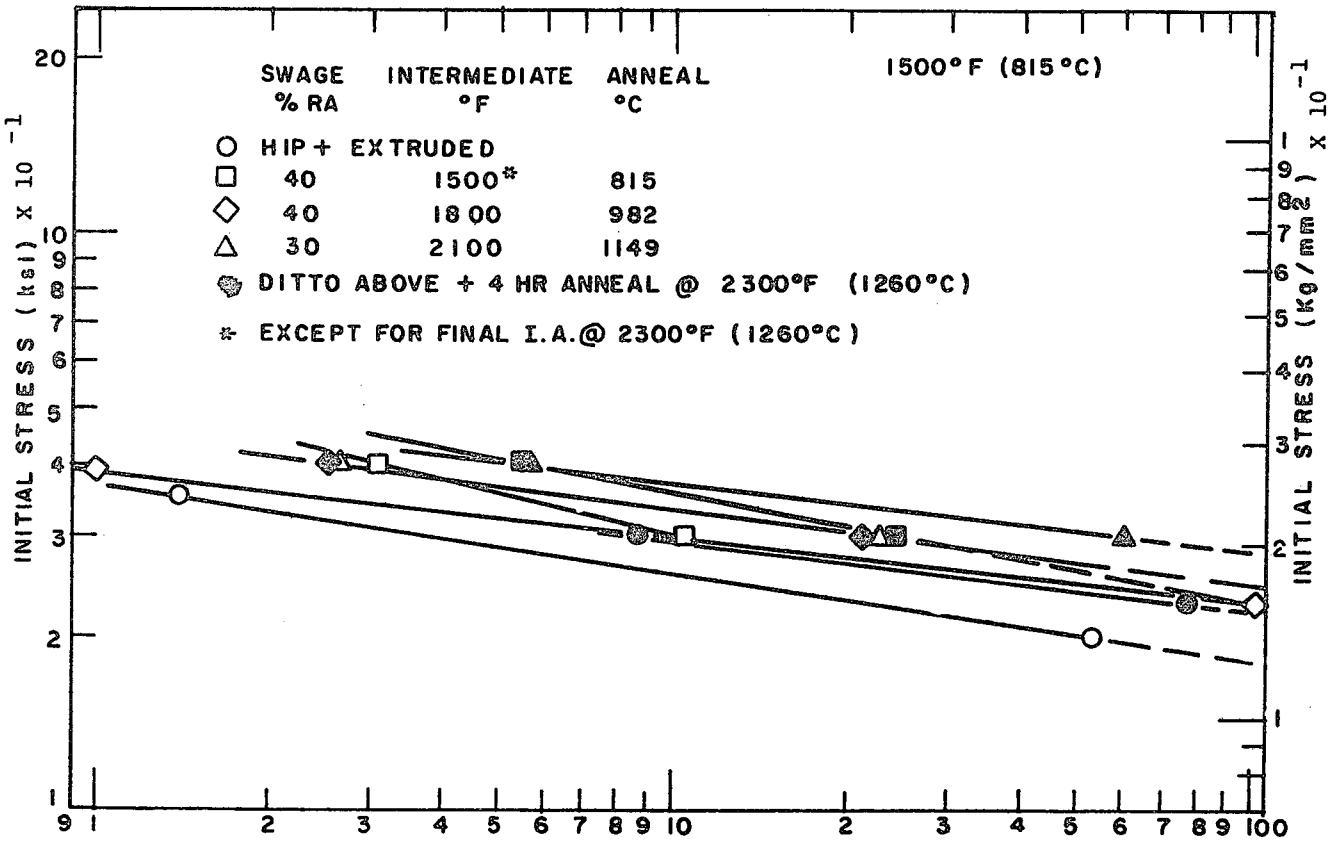
FIG. 9 is a graph like that of FIG. 8 except for a cobalt—3 atom % HfC alloy.
Figure 10:
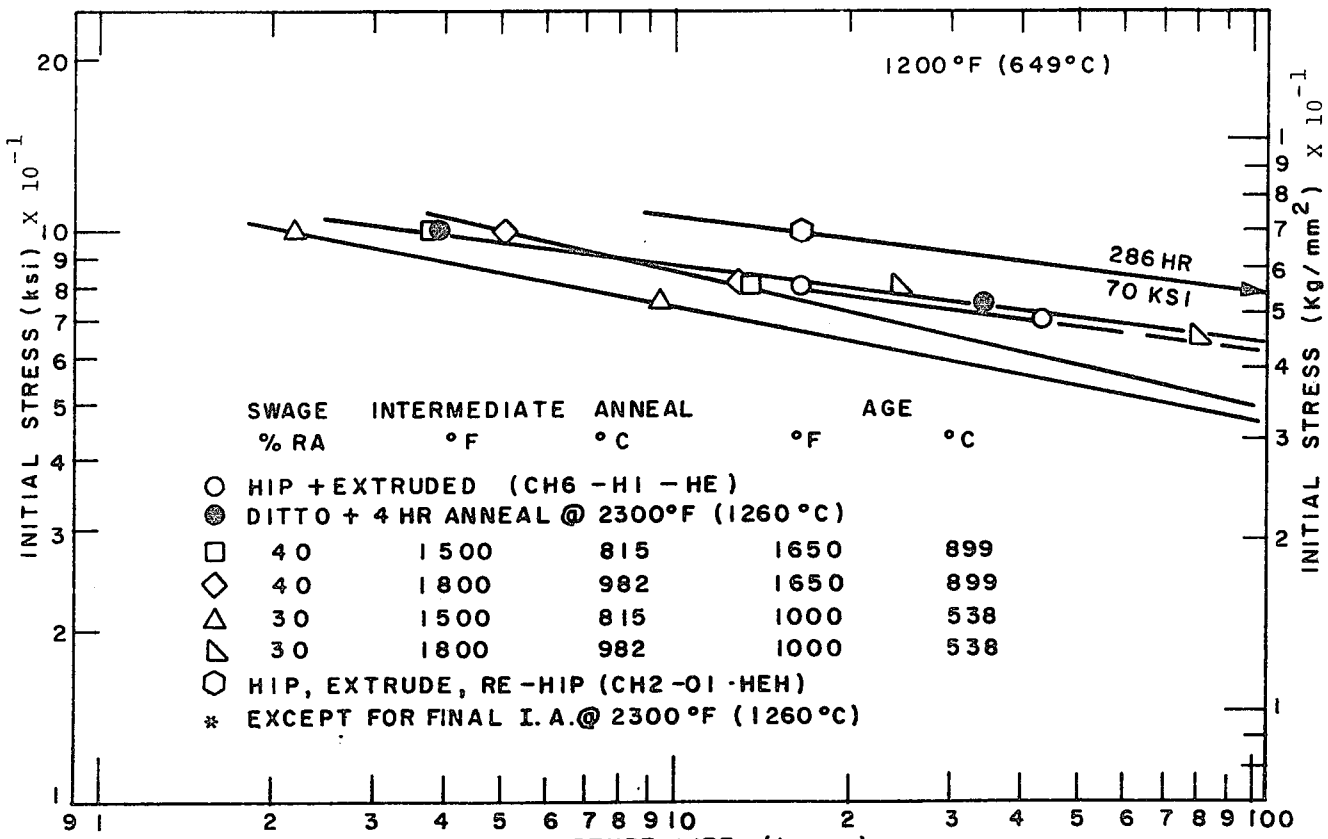
FIG. 10 is a graph like that of FIG. 8 except for P/M cobalt 1 and 3 atom % HfC alloys.
Figure 11:
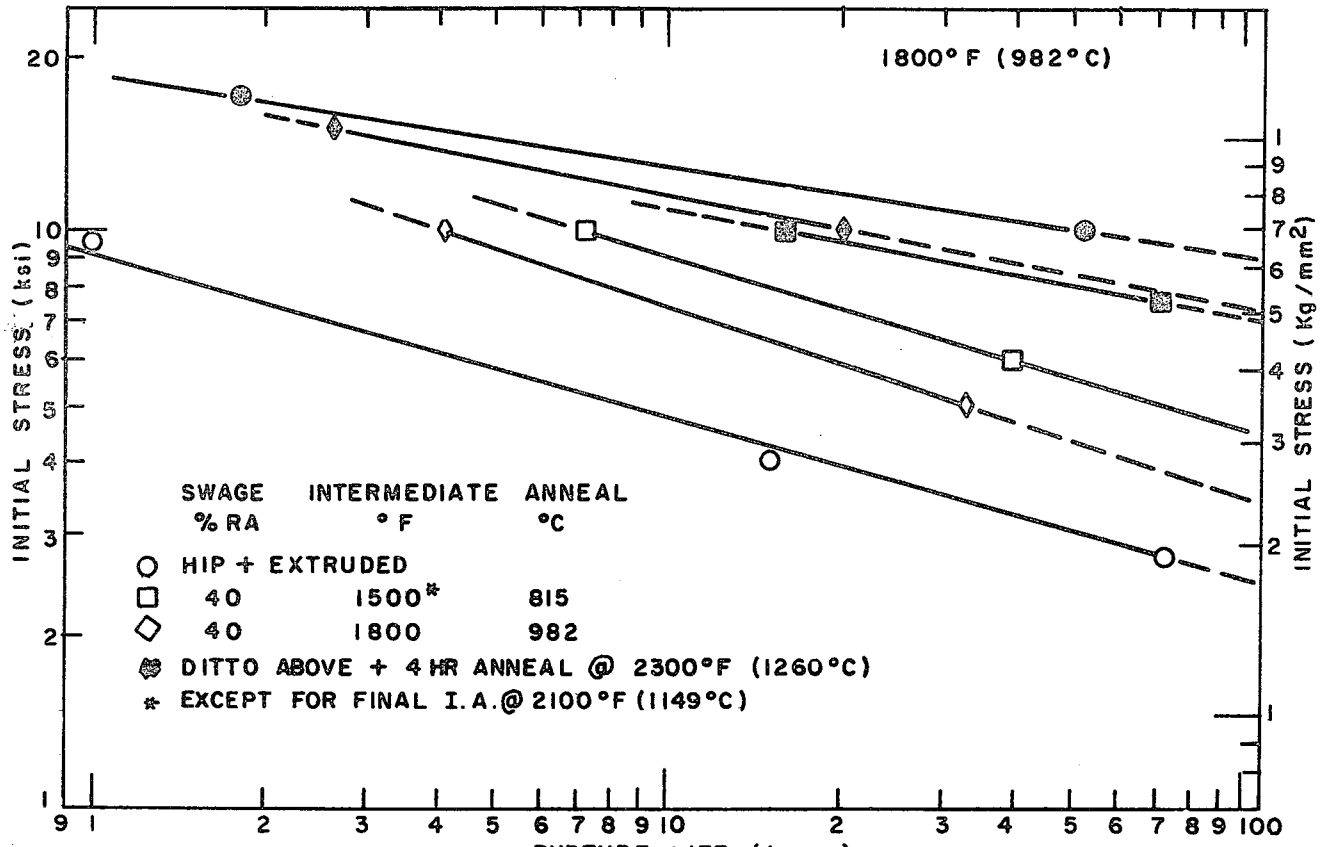
FIGS. 11 and 12 each are graphs like that of FIG. 8 except for a P/M alloy designated MAR-M-509 which is a commercially available alloy modified in accordance with the present teachings.
Figure 12:
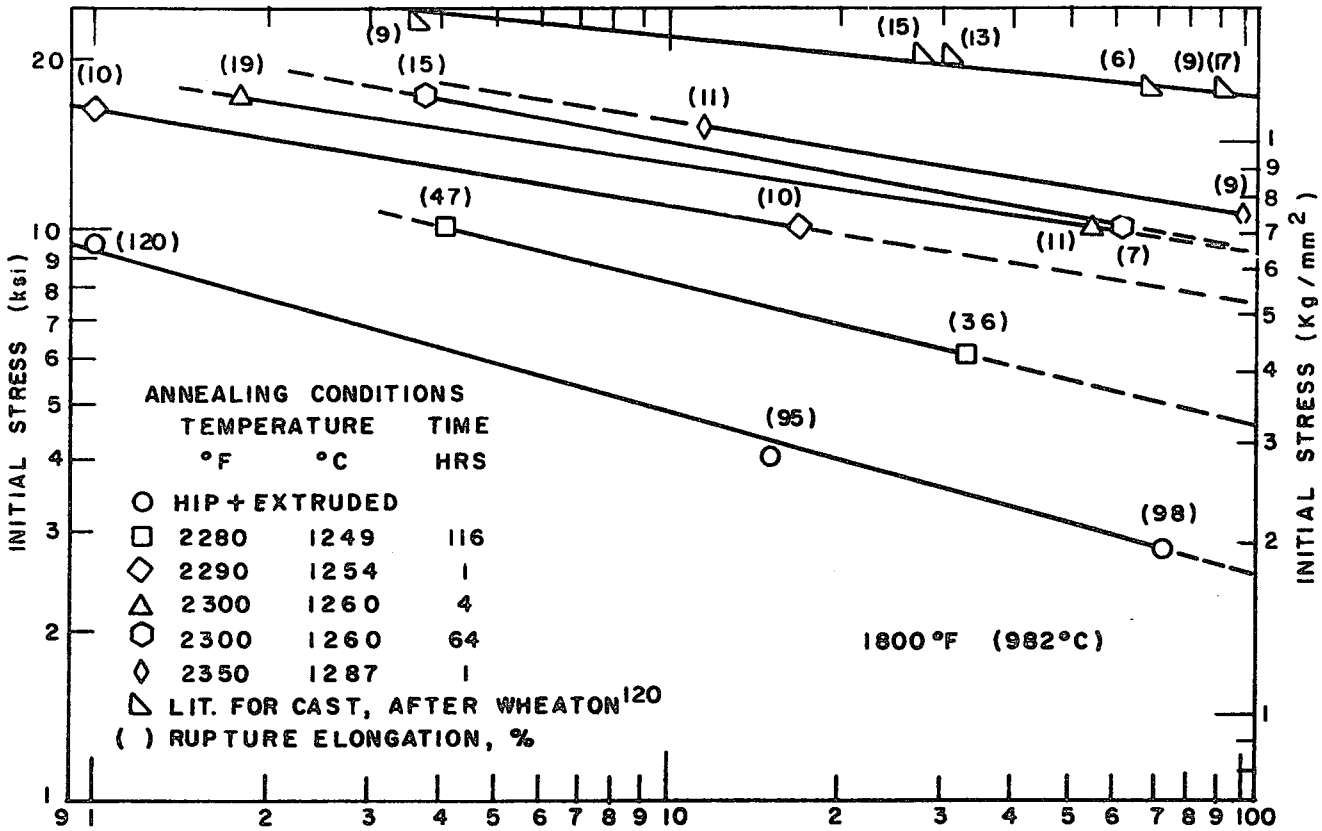

The foregoing teaching demonstrates that the rapid-quenching approach can be employed to modify and improve the structure and properties of contemporary cobalt-based casting alloys and to develop a new class of cobalt-based alloys which have a unique combination of strength, structure, stability, and oxidation resistance. There is produced a Co-HfC alloy which is sufficiently malleable (plastically deformable) to allow it to be processed into wrought form (FIG. 9). The powders or particulates can be consolidated directly by hot extrusion, rolling, forging, etc. or by hot isostatic pressing into a fully dense billet for hot working by extrusion, rolling, forging, etc. The alloy has extremely fine grain and carbide precipitate sizes, and exhibits excellent low temperature toughness even at temperatures lower than (−100° F.). It is also tough and strong at room temperature and high temperatures (2000° F. and up to 2300° F.), and exhibits yield strength and ultimate strength values which far exceed both cast or hot worked (wrought) contemporary cobalt-based superalloys. The following table shows the extremely high toughness or resistance to impact of the present class of alloys down to liquid nitrogen temperatures.

TABLE 4

| Alloy | ft.-lbs. 21° C. (70° F.) | ft.-lbs. −196° C. (−330° F.) |
|---|---|---|
| C51-01-He (MAR-M-509 alloy) | 7 | — |
| C52-06-HE (MAR-M-509 alloy) | 5 | 5 |
| CZ1-01-HE (Modified MAR-M-509 alloy) | 12 | — |
| CH1-01-HEH2 (Co-HfC-1 at %) | 82 | — |
| Ch7-H2-HE (Co-HFc-3 at %) | 20 | 22 |
| CH6-H1-HE (Co-HFc-6 at %) | 21 | 16 |

The rapid solidification to provide the desired results can be affected by splat cooling in combination with the powder or particulate forming techniques herein described, or, as an alternate approach, the liquid melt can be forced through one or more fine orifices to permit surface tension to provide spheres (atomization).

The foregoing discussion of the invention is directed to the preferred embodiment thereof, namely, that of providing cobalt-based alloys with an unusually large amount of hafnium (i.e. 3–18 weight percent hafnium) in the form HfC (2–24% by volume). The process described teaches a way of forming, preferentially, HfC in such alloys. The Robinson thesis (see conclusion 10, pages 152–153, and Appendix Table XII, page 201) illustrates the preferential formation of HfC to the exclusion of other carbides. But the invention is not restricted to cobalt-based alloys. As is previously noted, up to 40% of the cobalt can be substituted with nickel or iron plus nickel and, in general, the process described is useful to provide substantial amounts of hafnium in an alloy containing 10–30 weight % chromium, 4–12 weight % tungsten and/or molybdenum, 3–18 weight % hafnium, and sufficient carbon to produce hafnium carbide in an alloy wherein the alloy matrix is a ductile, tough, oxidation-resistant phase such as, for example, cobalt, nickel and/or nickel plus iron. The very essence of the invention is the discovery of a method whereby hafnium carbide can be formed preferentially, in fact to the exclusion of other carbides; further, this takes place in an alloy which contains other carbide forming constituents which would, in the absence of hafnium and the present teaching, form the less refractory, less desirable carbides. The hafnium carbide formed as taught herein has a particle size finer than about 3 microns because of the rapid solidification and appropriate consolidation steps.

Further modification of the invention herein described will occur to persons skilled in the art, and all such modifications are deemed to be within the spirit and scope of the invention as defined by the claims.

We claim:

1. An alloy product comprising:

A. 10–30 weight percent chromium;

B. 4–12 weight percent tungsten and/or molybdenum;

C. 2–24 volume percent hafnium carbide having a particle size of less than 3 microns; and, D. the balance being a cobalt solid solution matrix.

2. An alloy product as claimed in claim 1 wherein up to 40% of said cobalt solid solution matrix is replaced by a solid solution matrix chosen from a group consisting of nickel and a nickel-iron mixture.

3. An alloy product as claimed in claim 1 wherein the secondary dendritic arm spacing is in the order of $10^{-1}$ microns.

* * * * *